United States Patent [19]

Slyker

[11] Patent Number: 4,790,572

[45] Date of Patent: Dec. 13, 1988

[54] TAPERED WEDGE PACKOFF ASSEMBLY FOR A CASING HANGER

[75] Inventor: Richard W. Slyker, Houston, Tex.

[73] Assignee: Vetco Gray Inc., Houston, Tex.

[21] Appl. No.: 138,617

[22] Filed: Dec. 28, 1987

[51] Int. Cl.[4] ..... E21B 33/04; E21B 33/043

[52] U.S. Cl. ..... 285/140; 166/82; 166/208; 166/182; 277/117; 277/190; 277/236; 285/341; 285/348

[58] Field of Search ..... 166/208, 209, 217, 82, 166/84, 86, 88, 382, 387, 182; 277/117, 190, 191, 208, 236; 285/140, 341, 348

[56] References Cited

U.S. PATENT DOCUMENTS

| | | | |
|---|---|---|---|
| 3,489,219 | 1/1970 | Regan | 166/208 X |
| 4,131,287 | 12/1978 | Gunderson et al. | 277/191 |
| 4,469,172 | 9/1984 | Clark | 166/217 X |
| 4,595,053 | 6/1986 | Watkins et al. | 166/209 |
| 4,653,589 | 3/1987 | Alandy | 166/208 X |
| 4,665,979 | 5/1987 | Boehm, Jr. | 166/208 |
| 4,702,481 | 10/1987 | Brammer | 277/116.2 |
| 4,714,111 | 12/1987 | Brammer | 166/182 |
| 4,722,391 | 2/1988 | Brammer | 166/195 |

*Primary Examiner*—Stephen J. Novosad
*Attorney, Agent, or Firm*—James E. Bradley

[57] ABSTRACT

A packoff assembly for sealing between a casing hanger and a wellhead for a subsea well uses a tapered wedge. The tapered wedge locates between inner and outer seal rings formed of metal. When moved downward, the wedge member pushes the seal rings outward to form a metal seal. The seal rings are formed separate from and carried on a base member. The wedge member extends down into a cavity in the base member. Pins connect the wedge member to the base member to retain the seal ring, but allow longitudinal movement of the wedge movement relative to the base member. An elastomeric seal locates between the upper ends of the seal rings and a drive member which moves the wedge member downward.

5 Claims, 2 Drawing Sheets

TAPERED WEDGE PACKOFF ASSEMBLY FOR A CASING HANGER

BACKGROUND OF THE INVENTION

1. Field of the Invention

This invention relates in general to packoff assemblies located between a casing hanger and a wellhead, and in particular to a packoff assembly for a subsea well employing metal seals.

2. Description of the Prior Art

In a conventional subsea well, a wellhead will be located on the sea floor. Riser pipe will extend from the wellhead to a floating vessel on the surface. When running casing, a casing hanger is connected to the upper end of the casing string and landed on a shoulder in the wellhead. The casing hanger is lowered on a running tool.

After cementing, a packoff is positioned in the annular space between the casing hanger and the wellhead. The packoff may be carried by the running tool or lowered in a separate trip. There are a number of different types of packoffs in use and described in various patents. Some employ elastomeric seals, others metal seals, and others a combination of both.

SUMMARY OF THE INVENTION

The packoff assembly of this invention includes a pair of seal rings. The seal rings are spaced apart from each other, defining an annular cavity. The seal rings have wedge surfaces opposing each other. At least one of the wedge surfaces is tapered or at an inclined angle relative to the longitudinal axis of the casing hanger.

A wedge member is located in the annular cavity. The wedge member has mating wedge surfaces. When the wedge member is moved downward relative to the seal rings, it urges the seal rings outward to seal against the wellhead and the casing hanger. The seal rings are formed separately from each other and carried on a base member.

Preferably, an elastomeric seal is located above the wedge member and below a drive ring which moves the wedge member downward. When the drive ring moves downward, it deforms the elastomeric seal to provide a low pressure seal.

DESCRIPTION OF THE PREFERRED EMBODIMENT

Figure 1:
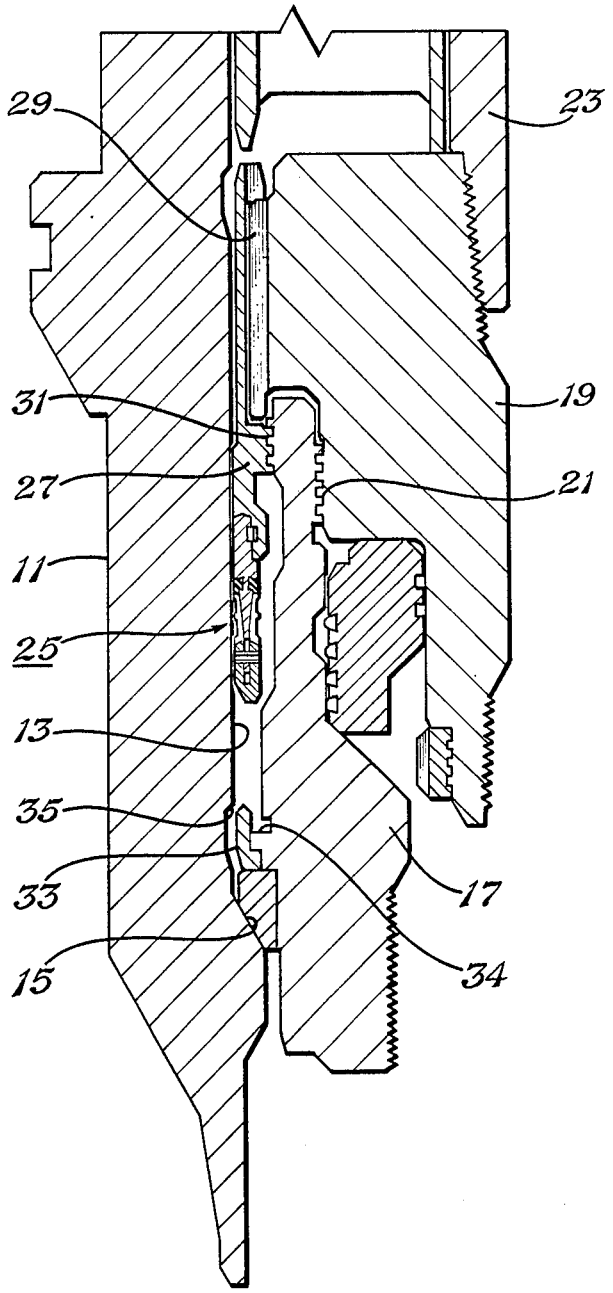
FIG. 1 is a partial vertical sectional view of a casing hanger and packoff assembly constructed in accordance with this invention.

Referring to FIG. 1, portions of a subsea wellhead 11 are shown. Wellhead 11 is a large tubular member located below the surface of the water on the ocean floor. Wellhead 11 has a bore 13 that contains an upward facing landing shoulder 15.

A conventional casing hanger 17 secured to a string of casing (not shown) is lowered on a conventional running tool 19. Running tool 19 has left-hand threads which engage threads 21 in the interior of the casing hanger 17. The running tool 19 is lowered on a string of drill pipe 23.

A packoff assembly 25 is carried by the casing hanger 17. Packoff assembly 25 is carried by a lock nut 27. Lock nut 27 is a tubular member with internal threads that engage right-hand threads 31 on the exterior of the casing hanger 17. Only the lower portion of the lock nut 27 threads are shown. Several longitudinal slots extend through the threads on the lock nut 27. The slots are engaged by keys 29 on the exterior of the running tool 19.

As the running tool 19 rotates to the right to disengage itself from the casing hanger internal threads 21, the lock nut 27 will rotate and advance downward on the threads 31 because of the keys 29. This moves the packoff assembly 25 down into the annular space between the casing hanger 17 and the bore 13. A shoulder 34 located on the exterior of the casing hanger 17 serves as a stop to limit the downward movement of the packoff assembly 25.

A split locking ring 33 is carried by the casing hanger 17 adjacent the shoulder 34. Locking ring 33 is adapted to be pushed outward by the lower end of the packoff assembly 25 into a recess 35 in bore 13. This prevents the casing hanger 17 from moving upward. J-slots (not shown) in the lock nut 27 allow the running tool 19 to be released from the lock nut 27 to retrieve the running tool 19 to the surface.

Figure 2:
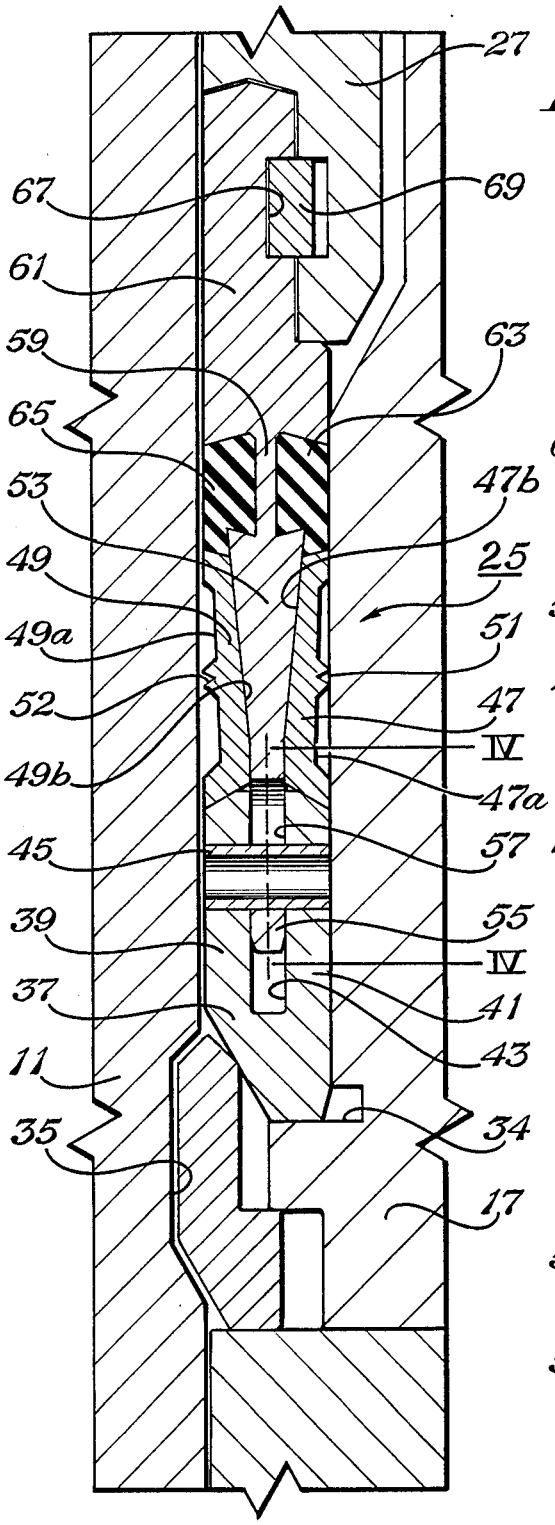
FIG. 2 is an enlarged vertical sectional view of the packoff assembly of FIG. 1.

Referring to FIG. 2, packoff assembly 25 includes a metal base ring or member 37. Base member 37 has an outer wall 39 and an inner wall 41. The outer wall 39 is spaced from the inner wall 41 by a central annular channel 43. Both the inner and outer sides of the walls 39, 41 are cylindrical. The outer diameter of the outer wall 39 is slightly less than the diameter of bore 13. The inner diameter of the inner wall 41 is slightly greater than the diameter of the casing hanger 17 at the point at which it locates when the packoff assembly 25 is actuated. One or more roll pins 45 (only one shown) extend radially between the outer wall 39 and the inner wall 41.

Inner and outer seal rings 47, 49, separately formed from the base member 37, are carried on top of the base member 37. The inner seal ring 47 has an inner surface **47*a* that seals against the casing hanger 17. The inner seal ring 47 has an outer wedge surface 47*b*. The outer wedge surface 47*b* is frusto-conical, having a taper of about six degrees relative to the longitudinal axis of the casing hanger 17**.

Similarly, outer seal ring 49 has an outer surface **49*a* that seals against bore 13. The outer seal ring 49 has an inner wedge surface 49*b* that is also at a six degree taper. It inclines inwardly, while wedge surface 47*b*** inclines outwardly. This results in a cavity between them that is tapered, having a smaller radial cross-sectional dimension at the bottom than at the top.

The inner seal ring inner surface **47*a* has three annular bands 51 that protrude inward to seal against the casing hanger 17. Similarly, the outer seal ring outer surface 49*a* has three spaced apart circumferential bands 52 protruding outwardly to seal against the bore 13. The bands 51, 52 in the center area of the seal rings 47, 49 have a V-shaped recess in the center. This shape helps sealing in the case where the wellhead bore 13 or casing hanger 17 is scored. The seal rings 47, 49 are preferably of a softer metal than the wellhead 11 and casing hanger 17. This causes the bands 51, 52 to deform to enhance sealing when forced against the casing hanger 17 and the bore 13. The seal rings 47, 49 are free to move slight distances in a radial direction relative to the base member 37**.

A wedge member 53 is carried in the cavity located between the seal rings 47, 49. Wedge member 53 is of harder metal than the seal rings 47, 49. Wedge member 53 has a cylindrical lower end 55 and a wedge-shaped configuration extending upward from the lower end 55. The wedge-shaped section has a smaller radial thickness at the bottom than at the top. The wedge-shaped section of wedge member 53 has frusto-conical inner and outer walls or wedge surfaces that incline and mate with the wedge surfaces 47*b* and 49*b*.

Figure 4:
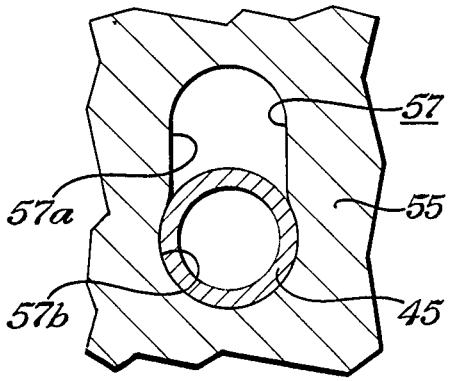
FIG. 4 is a sectional view of part of the wedge member of the packoff assembly of FIG. 2, taken along the line IV—IV of FIG. 2.

The inner and outer sides of the lower end 55 are cylindrical and slidingly received in the channel 43. An elongated aperture 57 is located in the lower end 55 for each roll pin 45. Referring to FIG. 4, the aperture 57 has a smaller width in the upper section 57*a* than in the lower section 57*b*. The width in the upper section 57*a* is less than the diameter of the roll pin 45. This causes the roll pin 45 to deform in an interference fit when the wedge member 53 is moved downward. The interference fit serves to retain the wedge member 53 in the lower position. The roll pin 45 and elongated aperture 57 retain the wedge member 53 and the seal rings 47, 49 with the base member 37 while the wedge member 53 is in the upper position.

Figure 3:
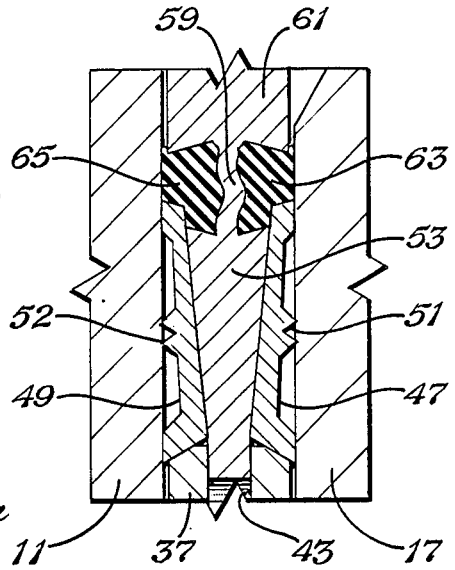
FIG. 3 is a partial sectional view of the packoff assembly of FIG. 2, and showing the packoff assembly actuated.

A relatively thin annular web section 59 extends upward from the upper end of the wedge member 53. The web section 59 joins a drive member 61. The web section 59 has a radial thickness that is much less than the radial thickness of the upper end of the wedge member 53. Also, the web section 59 is much thinner than the drive member 61. The web section 59 is thick enough to transmit downward force from the drive member 61, but thin enough to deflect once the wedge member 53 is in its lowermost position, as indicated in FIG. 3.

Inner and outer elastomeric seals 63, 65 are located around the inner and outer sides of the web section 59. The inner and outer seals 63, 65 locate between the lower end of the drive member 61 and the upper ends of the seal rings 47, 49. The drive member 61 has an inner annular cavity 67 that receives a retaining ring 69. Retaining ring 69 couples the drive member 61 to the lock nut 27, but allows the lock nut 27 to rotate relative to the drive member 61.

In operation, referring to FIG. 1, the casing hanger 17 is secured to the upper end of a string of casing (not shown). The running tool 19 is secured to the casing hanger 17 by the internal threads 21. The running tool 19 is lowered on drill pipe 23. The packoff assembly 25 is carried by the casing hanger 17 through the lock nut 27 and threads 31. It will be carried in the upper position shown in FIG. 1 while the string is lowered into the well.

After the casing hanger 17 lands on the shoulder 15, cement is pumped down the drill pipe 23 to cement the annular space surrounding the casing. Return fluid flows up through slots (not shown) provided in the spaces between the casing hanger 17 and bore 13.

After cementing is completed, the drill pipe 23 is rotated to the right. This causes the running tool 19 to begin disengaging from the threads 21. At the same time, the keys 29 will rotate the lock nut 27, causing it to move downward on the threads 31. This moves the packoff assembly 25 downward. Eventually, the base member 37 (FIG. 2) will contact the locking ring 33 and push it outward into the recess 35 to lock the casing hanger 17 in place. The base member 37 lands on shoulder 34, preventing any farther downward movement.

Referring to FIG. 2, the lock nut 27 will rotate while the drive member 61 remains stationary. The advancement on the threads 31 (FIG. 1), causes the wedge member 53 to begin to move downward relative to the seal rings 47, 49 once the base member 37 has contacted shoulder 34. The wedge member 53 forces the seal rings 47, 49 radially outward against the bore 13 and the casing hanger 17. The drive member 61 in its downward movement relative to the rings 47, 49, compresses the elastomeric seals 63, 65.

When the specified amount of rotatation has taken place, the web 59 may deflect, as shown in FIG. 3. Whether or not the web 59 deflects depends upon the accuracy of the initial dimensions between the base member 37 and the shoulder 34, and also the dimensions between the bore 13 and the casing hanger 17. The deflection assures that the drive member 61 moves downward sufficiently relative to the seal rings 47, 49 to properly deform the elastomeric seals 63, 65.

A pressure test is made once rotation of the drill string 23 has been completed. The pressure will act on the wedge member 53 to move it farther downward, forcing the seal rings 47, 49 radially into tighter and final sealing engagement with the casing hanger 17 and bore 13. The softer metal of the seal rings 49, 51 than the casing hanger 17, bore 13, and wedge member 53, causes the bands 51, 52 to deform slightly. The test pressure acting on the wedge member 53 also deforms the elastomeric seals 63, 65 into sealing engagement with the casing hanger 17 and bore 13.

Then, the running tool 19 may be disengaged by means of the J-slots (not shown) in the lock nut 27. Slight left-hand rotation and upward pull of the drill string 23 causes the running tool 19 to release from the lock nut 27. The running tool 19 and the drill pipe 23 are pulled to the surface. The lock nut 27 retains the packoff assembly 25 in the actuated position due to the engagement of the threads 31.

Any pressure in the annulus below the packoff assembly 25 will cause tighter sealing engagement. Each pressure area on the lower end of the seal rings 47, 49 is larger than the pressure area on the lower end of the wedge member 53. Also any upward force on the wedge member 53 is resisted by the drive ring 61, which is locked to the casing hanger 17. As a result, any movement due to an upward force would result in the rings 47, 49 moving upward relative to the wedge member 53, increasing the lateral forces on the rings 47, 49 which cause sealing.

If, at a later date, it is desired to retrieve the packoff assembly 25, a retrieving tool (not shown) may be lowered into engagement with the J-slots of the lock nut 27. The lock nut 27 is unscrewed from the casing hanger 17. The wedge member 53 will pull upward from the lower position, releasing the seal rings 47, 49 from sealing engagement with the casing hanger 17 and bore 13. Packoff assembly 25 can then be removed to the surface.

The invention has significant advantages. Because of the wedge shape of the wedge member, the seal rings energize at fairly low torque and low pressure. The test pressure will cause final sealing of the metal seals, reducing the amount of torque required. The wedge member is self locking. The seal rings are free to float relative to the base member to accommodate non-concentric orientations of a hinger within a wellhead. The low pressure elastomeric seal is an assistance in the event of heavy scoring of the sealing surfaces or debris that may prevent an initial metal-to-metal seal. The soft metal of the seal rings provides sealing even in the case of scoring and pitting on the sealed surfaces.

While the invention has been shown in only one of its forms, it should be apparent to those skilled in the art that it is not so limited, but is susceptible to various changes without departing from the scope of the invention.

I claim:

1. In a wellhead assembly having a wellhead within which a casing hanger lands, an improved packoff assembly for sealing between the wellhead and casing hanger, comprising in combination:

a metal seal member having inner and outer seal rings, the inner seal ring having an inner wall for sealing against the hanger, the outer seal ring having an outer wall for sealing against the wellhead;

the inner seal ring having an outer wedge surface, the outer seal ring having an inner wedge surface spaced from and opposing the outer wedge surface to define a central cavity;

an annular wedge member located in the central cavity and having inner and outer wedge surfaces which mate slidingly with the wedge surfaces of the seal rings;

a drive member located above the wedge member;

a web section joining the upper end of the wedge member with the lower end of the drive member;

inner and outer elastomeric seals located on the inner and outer sides, respectively, of the web section and spaced between the lower end of the drive member and the upper ends of the seal rings; and means for moving the drive member from an upper position downward to a lower position relative to the seal rings, moving the wedge member downward for driving the seal rings apart to provide a metal high pressure seal between the hanger and the wellhead, and deforming the elastomeric seals between the drive member and the seal rings to provide a low pressure seal between the hanger and the wellhead.

2. In a wellhead assembly having a wellhead within which a casing hanger lands, an improved packoff assembly for sealing between the hanger and the wellhead, comprising in combination:

a metal seal member having inner and outer seal rings, the inner seal ring having an inner wall for sealing against the hanger, the outer seal ring having an outer wall for sealing against the wellhead;

the inner seal ring having an outer wedge surface, the outer seal ring having an inner wedge surface spaced from and opposing the outer wedge surface to define a central cavity;

an annular wedge member located in the central cavity and having inner and outer wedge surfaces which mate slidingly with the wedge surfaces of the seal rings;

a drive member located above the wedge member;

a web section joining the upper end of the wedge member with the lower end of the drive member, the web section having a radial cross-sectional thickness that is less than the radial cross-sectional thickness of the lower end drive member and the upper end of the wedge member;

inner and outer elastomeric seals located on the inner and outer sides, respectively, of the web section and between the drive member and the upper ends of the seal rings;

means for moving the drive member from an upper position downward to a lower position relative to the seal rings, moving the wedge member downward for driving the seal rings apart to provide a high pressure seal between the hanger and the wellhead, and for deforming the elastomeric seals to provide a low pressure seal between the hanger and the wellhead; and the radial thickness of the web section being sufficiently thin to deflect should the drive member continue downward movement after the wedge member has reached its lowermost position.

3. In a wellhead assembly having a wellhead within which a casing hanger lands, an improved packoff assembly for sealing between the hanger and the wellhead, comprising in combination:

a metal base member having inner and outer walls separated by an annular channel;

inner and outer seal rings carried on the upper end of the base member and separated from each other by a central cavity which aligns with the annular channel in the base member, the inner seal ring having an inner wall for sealing against the hanger, the outer seal ring having an outer wall for sealing against the wellhead, the inner and outer seal rings being separate from the base member and radially movable relative to the base member;

the inner seal ring having an outer wedge surface, the outer seal ring having an inner wedge surface spaced from and opposing the outer wedge surface to define the central cavity;

an annular wedge member located in the central cavity and having inner and outer wedge surfaces which mate slidingly with the wedge surfaces of the seal rings, and a lower end which is received in the annular channel of the base member;

means for connecting the lower end of the wedge member to the base member for retaining the wedge member and seal rings with the base member, and for allowing longitudinal movement of the wedge member relative to the base member; and means for moving the wedge member from an upper position downward to a lower position relative to the base member for driving the seal rings apart to seal against the hanger and the wellhead.

4. In a wellhead assembly having a wellhead within which a casing hanger lands, an improved packoff assembly for sealing between the hanger and the wellhead, comprising in combination:

a metal base member having inner and outer walls separated by an annular channel;

inner and outer seal rings carried on the upper end of the base member and separated by a central cavity which aligns with the annular channel in the base member, the inner seal ring having an inner wall with at least one annular band protruding therefrom for sealing against the hanger, the outer seal ring having an outer wall with at least one annular band protruding therefrom for sealing against the wellhead, the inner and outer seal rings being separate from the base member and radially movable relative to the base member;

the inner seal ring having an outer wedge surface, the outer seal ring having an inner wedge surface spaced from and opposing the outer wedge surface to define the central cavity, each of the wedge surfaces being inclined in opposite directions relative to a longitudinal axis of the casing hanger to provide the central cavity with decreasing radial crosssectional width in a downward direction;

an annular wedge member located in the central cavity and having inclined inner and outer wedge surfaces which mate slidingly with the wedge surfaces of the seal rings, and a lower end which is received in the annular channel of the base member;

a web section joinng the upper end of the wedge member with the lower end of the drive member;

inner and outer elastomeric seals located on the inner and outer sides, respectively, of the web section and spaced between the lower end of the drive member and the upper ends of the seal rings;

means for connecting the lower end of the wedge member to the base member to retain the wedge member and seal rings with the base member and for allowing longitudinal movement of the wedge member relative to the base member; and means for moving the drive member from an upper position downward to a lower position relative to the seal rings, moving the wedge member downward for driving the seal rings apart to provide a metal high pressure seal between the hanger and the wellhead, and deforming the elastomeric seals between the drive member and the seal rings to provide a low pressure seal between the hanger and the wellhead.

5. In a wellhead assembly having a wellhead within which a casing hanger lands, an improved packoff assembly for sealing between the hanger and the wellhead, comprising in combination:

a metal base member having inner and outer walls separated by an annular channel;

inner and outer seal rings carried on the upper end of the base member and separated by a central cavity which aligns with the annular channel in the base member, the inner and outer seal rings being separate from the base member and radially movable relative to the base member;

the inner seal ring having an outer wedge surface, the outer seal ring having an inner wedge surface spaced from and opposing the outer wedge surface to define the central cavity;

an annular wedge member located in the central cavity and having inner and outer wedge surfaces which mate slidingly with the wedge surfaces of the seal rings, and a lower end which is received in the annular channel of the base member;

an elongated aperture formed in the lower end of the wedge member;

pin means extending radially between the inner and outer walls of the base member and through the aperture in the wedge member for connecting the wedge member to the base member, and for allowing longitudinal movement of the wedge member relative to the base member; and means for moving the wedge member from an upper position downward to a lower position relative to the base member for driving the seal rings apart to seal against the hanger and the wellhead.

* * * * *